US007218740B1

(12) United States Patent
Kowaki

(10) Patent No.: US 7,218,740 B1
(45) Date of Patent: May 15, 2007

(54) AUDIO SYSTEM

(75) Inventor: Hiroshi Kowaki, Kobe (JP)

(73) Assignee: Fujitsu Ten Limited, Kobe-shi (JP)

( * ) Notice: Subject to any disclaimer, the term of this patent is extended or adjusted under 35 U.S.C. 154(b) by 0 days.

(21) Appl. No.: 09/578,355

(22) Filed: May 24, 2000

(30) Foreign Application Priority Data

May 27, 1999 (JP) ..... 11-148317

(51) Int. Cl.
*H04R 5/00* (2006.01)

(52) U.S. Cl. ..... 381/18

(58) Field of Classification Search ..... 381/86.1, 381/17–21, 389, 119–309, 102, 103, 104, 381/86, 1, 310, 23
See application file for complete search history.

(56) References Cited

U.S. PATENT DOCUMENTS

| | | | | |
|---|---|---|---|---|
| 4,256,922 | A * | 3/1981 | Gorike | 381/308 |
| 4,569,074 | A * | 2/1986 | Polk | 381/1 |
| 4,574,391 | A * | 3/1986 | Morishima | 381/18 |
| 5,033,086 | A * | 7/1991 | Fidi | 381/310 |
| 5,128,999 | A * | 7/1992 | Yanagawa | 381/22 |
| 5,278,909 | A * | 1/1994 | Edgar | 381/17 |
| 5,305,386 | A * | 4/1994 | Yamato | 381/1 |
| 5,438,623 | A * | 8/1995 | Begault | 381/17 |
| 5,590,204 | A * | 12/1996 | Lee | 381/300 |
| 5,671,287 | A * | 9/1997 | Gerzon | 381/17 |
| 6,009,179 | A * | 12/1999 | Wood et al. | 381/17 |
| 6,332,026 | B1 * | 12/2001 | Kuusama et al. | 381/17 |
| 6,584,202 | B1 * | 6/2003 | Montag et al. | 381/63 |

FOREIGN PATENT DOCUMENTS

| | | | |
|---|---|---|---|
| EP | 0 642 292 A2 | | 3/1995 |
| EP | 642292 | * | 3/1995 |
| JP | 1-220599 A | | 9/1989 |
| JP | 02 086398 A | | 3/1990 |
| JP | 3-268700 A | | 11/1991 |
| JP | 07-087598 | * | 3/1995 |

OTHER PUBLICATIONS

European Search Report of corresponding EPO patent application, dated Oct. 18, 2002.

Patent Abstract of Japan, Publication No. 01220599, Published Sep. 4, 1989, in the name of Fujitsu ten Ltd.

Patent Abstract of Japan, Publication No. 03268700, Published Nov. 29, 1991, in the name of Matsushita Electric Ind Co Ltd.

Patent Abstract of Japan, Publication No. 07-087598, Published Mar. 31, 1995, in the name of Blaupunk-Werke Gmbh.

* cited by examiner

*Primary Examiner*—Vivian Chin
*Assistant Examiner*—Lun-See Lao
(74) *Attorney, Agent, or Firm*—Christie, Parker & Hale LLP

(57) ABSTRACT

An automotive in-cabin audio system comprising a plurality of speakers installed at different positions in the cabin is disclosed, in which the playback signal from a multichannel player having sources of at least three channels recorded therein is processed in accordance with the position of a listener seated in the cabin thereby to reproduce a sound similar to the original sound at the position of the listener. The signal of the sound reproduced from a speaker far from each seat in the cabin is retrieved as a branch signal and delayed in accordance with the law of the first wave front. At the same time, the level of the particular signal is attenuated to produce a processed sound signal, which is added to the signal of the sound reproduced from the speaker near each seat. As a result, a sound similar to the original sound can be heard at any hearing position in the cabin.

30 Claims, 11 Drawing Sheets d1~d6: DELAY TIME d1～d6: DELAY TIME d1～d6: DELAY TIME d1～d6: DELAY TIME dt: DELAY TIME dt: DELAY TIME dt: DELAY TIME d7, d8: DELAY TIME

Fig.11

| | GAIN | | |
|---|---|---|---|
| SPEAKER POSITION / PRIORITY MODE | CENTER | FRONT | REAR |
| FRONT SEATS | MIDDLE | MIDDLE | LARGE |
| MIDDLE SEATS | MIDDLE | MIDDLE | MIDDLE |
| REAR SEATS | LARGE | LARGE | MIDDLE |

AUDIO SYSTEM

BACKGROUND OF THE INVENTION

1. Field of the Invention

The present invention relates to an automotive in-cabin audio system or, in particular, to an improvement of the audio effect of an automotive in-cabin audio system in which an independent signal is sent to each of a plurality of speakers in the cabin from a multichannel player, that can reproduce the music sources of a multichannel recording system, such as a DVD (digital versatile disk) player.

2. Description of the Related Art

Conventionally, vehicles such as automobiles are equipped with an audio system for enjoying music in the cabin. In early stages of development, a simple two-channel stereophonic system comprising two speakers arranged on the left and right side was the mainstay of the audio system installed in the cabin. The demand for enjoying better music in the cabin, however, has promoted the extension of an in-cabin audio system with an increased number of speakers installed in the cabin.

An in-cabin audio system having six speakers is an example. The six speakers include, for example, a center speaker installed at the front center in the cabin, a left front speaker and a right front speaker installed on the front left side and the front right side in the cabin, a left rear speaker and a right rear speaker installed on the rear left side and the rear right side in the cabin, and a woofer. As an advanced form of this 6-speaker system, a tweeter is added to each of the left and right front speakers. In this audio system, the sound is reproduced from each speaker by correcting the frequency characteristic and processing the reverberation of the sound distributed to the left and right channels. In the process, the sound heard by an occupant in a rear seat, for example, produces an audio effect based mainly on the sound output from the rear speakers.

Recent years, on the other hand, have seen the extension of a multichannel audio system with an increased number of channels for music sources in place of the two-channel music sources such as the audio cassette and CD. A DVD system employing an independent 6-channel or 8-channel digital surround system is an example of the multichannel audio system.

In the DVD digital surround system, the music sources are reproduced from six speakers arranged in the cabin from the disks in which the music sources are recorded for the six speakers by independent multichannel recording systems. The six speakers for the DVD system include a center speaker, a front left speaker, a front right speaker, a rear left speaker, a rear right speaker and a woofer. The sound reproduced from the woofer is a low-pitched sound of not higher than 120 Hz and has a smaller amount of information than the other channels reproducing up to 20 kHz. The six channels in the DVD, therefore, are called 5.1 channels.

If it is assumed that the six speakers described are mounted in an automobile, in the case where an occupant (listener) is seated in the rear right seat, for example, the same sound is reproduced basically from the front right speaker and the rear right speaker of the conventional two-channel stereo system. In the case where the same sound is reproduced from the front right speaker and the rear right speaker, therefore, the sound heard by the listener seated in the rear right seat is governed by the rear right speaker.

In the case where the sound of 5.1 channels described above is reproduced from the six speakers, on the other hand, the sound reproduced from the five speakers other than the woofer can be freely controlled in view of the fact that the sound of the six channels are recorded in the recording media independently. The sound can run around the listener, for example, in the case where the same sound is reproduced from the five speakers each with a predetermined time lag.

In the case where a music source is reproduced in such a manner that the sound runs around the listener as described above, however, the problem is that the sound heard by the listener seated in the rear right seat from the front left speaker far from him is low in pressure with the high-pitched sound attenuated while the sound heard from the rear right speaker is high in pressure with a wide bandwidth with the result that the same sound is heard as a different sound for the listener.

This problem arises from the difference of the sound pressure and the frequency characteristic between the sound reproduced from the speakers far from the listening position and the speakers situated near the listener who listens to the independent sounds of many channels of multichannel sources reproduced from a plurality of speakers. In the case where the sound reproduced from the front speakers and the rear speakers mounted on the vehicle are different, for example, the sound originating from the front speakers and the sound originating from the rear speakers are heard differently by the occupant of the rear seat. In such a case, the sound coming from the front speakers is lower in sound pressure than the sound from the rear speakers and tends to have a deteriorated frequency characteristic, especially in the high frequency range.

SUMMARY OF THE INVENTION

Accordingly, the object of the present invention is to provide an in-cabin audio system in which multichannel sources recorded in a medium are reproduced from speakers located at as many positions as the channels in such a manner that the signal reproduced from the medium by the player is processed in an amplifier unit arranged in the stage before each speaker in accordance with the position of the person listening to the reproduced sound, thereby making it possible to reproduce the sound similar to the original sound from the medium at the position of the listener.

In order to achieve the object described above, the present invention is presented in first to seventh aspects described below.

According to a first aspect of the configuration of the invention, there is provided an audio system comprising a plurality of speakers located at a plurality of different positions in the automotive cabin, processed sound signal production means for separately retrieving the signal of the sound reproduced from a speaker located far from each seat in the cabin and delaying the particular signal in accordance with the distance to each speaker while at the same time attenuating the level of the particular signal in accordance with a predetermined law thereby to produce a processed sound signal, and signal adding means for adding the particular processed sound signal to the signal of the sound reproduced from a speaker near each seat.

According to a second aspect of the configuration of the invention, there is provided an audio system comprising a plurality of speakers located at a plurality of different positions in the automotive cabin, first signal adding means for separately retrieving and adding the signals of the sound reproduced from a plurality of the speakers located at positions far from each seat in the cabin, processed sound signal producing means for delaying the added signal in accordance with the distance to each speaker while at the same time attenuating the signal level in accordance with a predetermined law thereby to produce a processed sound signal, signal distribution means for distributing the processed sound signal among one or a plurality of speakers near each seat, and second signal adding means for adding each of the distributed signals of the sound reproduced from the speakers near each seat.

According to a third aspect of the configuration of the invention, there is provided an audio system in which the processed sound signal producing means in the first or second aspect further includes means for correcting the frequency characteristic of the processed sound signal.

According to a fourth aspect of the configuration of the invention, there is provided an audio system in which a plurality of the speakers of the in-cabin audio system in the third aspect are configured with a center speaker installed at the front center in the cabin, a left front speaker and a right front speaker installed on the front left and front right sides, respectively, in the cabin, a left rear speaker and a right rear speaker installed on the rear left and right sides, respectively, in the cabin and a woofer.

According to a fifth aspect of the configuration of the invention, there is provided an audio system described in the fourth aspect, in which a device for sending a playback signal to the six speakers is a multichannel player for reproducing the signal recorded in a recording medium according to the multichannel recording system.

According to a sixth aspect of the configuration of the invention, there is provided an audio system in which in the case where the sources of six channels are recorded in the recording medium and reproduced by the multichannel player in the fifth aspect, the sound output from the center speaker and the left and right front speakers are added to the sound output from the left and right rear speakers, respectively, and the sound output from the left and right rear speakers are added to the left and right front speakers and the center speaker, respectively.

According to a seventh aspect of the configuration of the invention, there is provided an audio system in which, in the case where the sources of six channels are recorded in a recording medium and reproduced by the multichannel player in the sixth aspect, the sound output from the center speaker and the left and right front speakers are added to the sound output from the left and right rear speakers, respectively, and the sound output from the left and right rear speakers are added to the left and right front speakers, respectively.

According to an eighth aspect of the configuration of the invention, there is provided an audio system further comprising, in any one of the first to seventh aspects, a priority mode setting switch for determining a particular seat in the cabin which receives the optimum sound, in which the sound pressure of the center speaker, the left and right front speakers and the left and right rear speakers are changed in accordance with the setting of the switch.

According to the first to eighth aspects, in the case where the multichannel sources recorded in a medium are reproduced from speakers installed at as many points as the channels, the signal reproduced from the player for the medium is processed by the amplifier unit arranged in the stage before each speaker in accordance with the position of the listener listening to the sound reproduced from each speaker.

BRIEF DESCRIPTION OF THE DRAWINGS

The present invention will be more clearly understood from the description as set forth below with reference to the accompanying drawings, wherein:

FIG. 11 is a diagram showing the relation between the seat priority mode and the gain of each speaker for a three-row seat vehicle according to the invention.

DESCRIPTION OF THE PREFERRED EMBODIMENTS

A preferred embodiment of the invention will be described in detail below.

Figure 1:
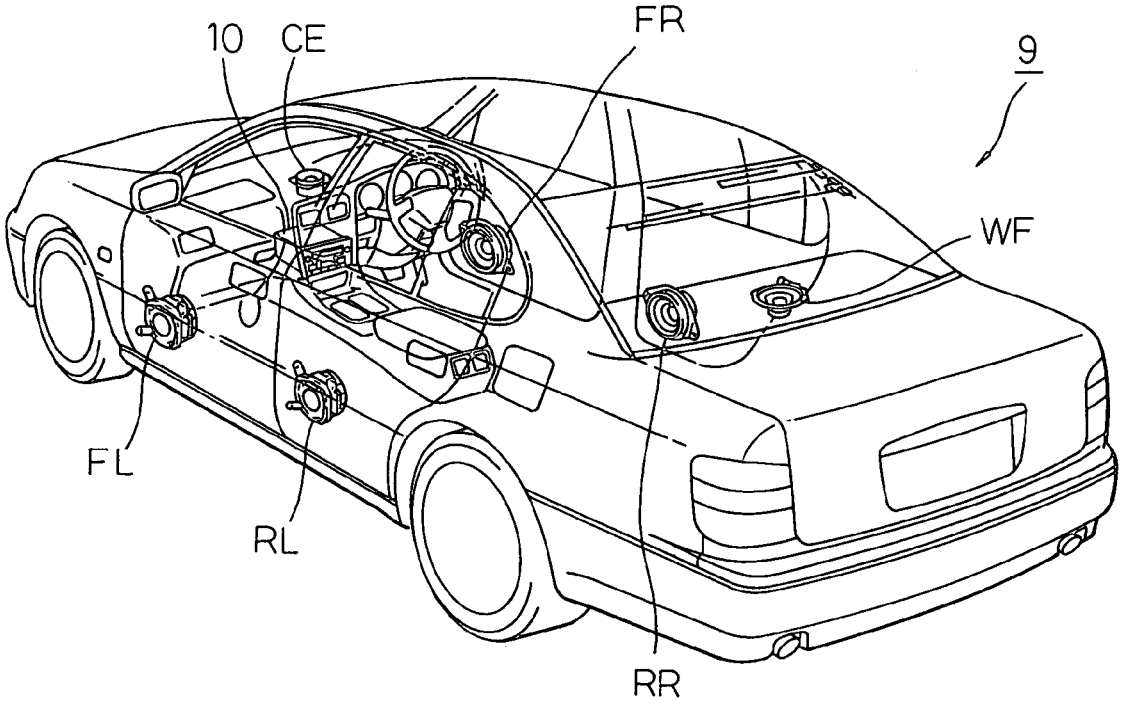
FIG. 1 is a perspective view showing the positions at which a plurality of speakers are installed in an automotive vehicle having an in-cabin audio system according to the invention.

FIG. 1 is a perspective view showing the positions where a plurality of speakers are installed in an automotive vehicle 9 equipped with an in-cabin audio system according to this invention. In FIG. 1, reference numeral 10 designates an audio unit installed on the instrument panel of the vehicle 9, characters CE a center speaker arranged at the central portion of the upper surface of the instrument panel of the vehicle, characters FL a left front speaker installed at the lower portion of the left front door, characters FR a right front speaker installed at the lower portion of the right front door, characters RL a left rear speaker installed at the lower portion of the left rear door, characters RR a right rear speaker installed at the lower portion of the right rear door, and characters WF a woofer for low-pitched sound installed on the rear shelf. According to this embodiment, the audio unit 10 is equipped with a DVD player as a multichannel player. The 6-channel signal reproduced by the DVD player is output to each speaker after being demodulated, corrected and amplified by the audio-unit 10.

Figure 2:
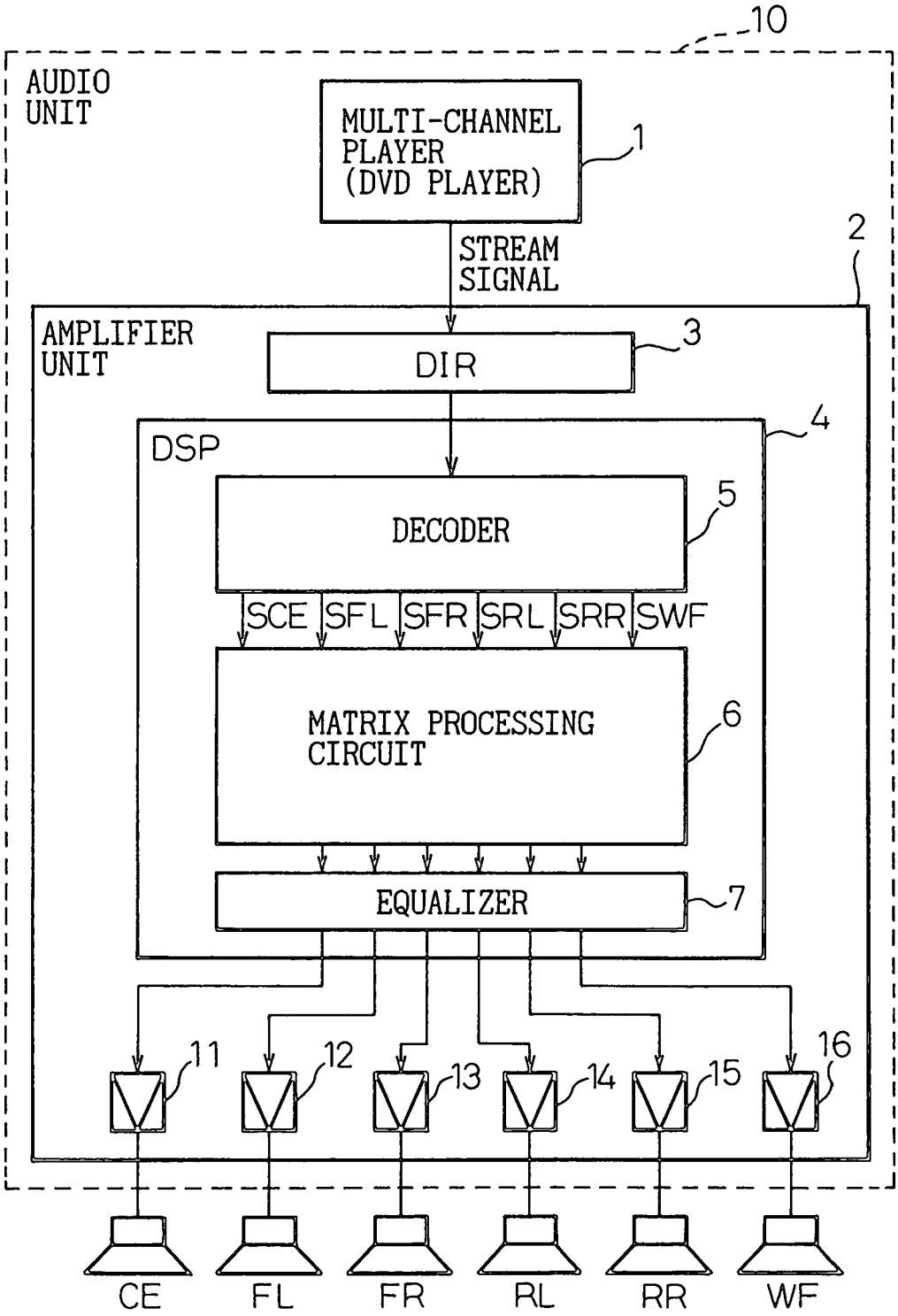
FIG. 2 is a block diagram for explaining the configuration of an in-cabin audio system according to the invention.

FIG. 2 is a diagram for explaining the configuration of an in-cabin audio system according to the invention and shows the connection between the audio unit 10 of FIG. 1 and each speaker. The audio unit 10 includes a DVD player 1 which is a multichannel player and an amplifier unit 2. The amplifier unit 2 is connected with the center speaker CE, the left and right front speakers FL, FR, the left and right rear speakers RL, RR and the woofer WF. A stream signal (digital signal) reproducing six channels is input from the DVD player 1 to the amplifier unit 2.

The amplifier unit 2 includes a DIR (digital interface receiver) 3, a DSP (digital signal processor) 4 and amplifiers 11 to 16 for driving the speakers. The DSP 4 includes a decoder 5, a matrix processing circuit 6 and an equalizer 7. The equalizer 7 is a multi-purpose equalizer such as a graphic equalizer or a parametric equalizer. The stream signal input from the DVD player 1 to the amplifier unit 2 is received by the DIR 3 and input to the decoder 5. The decoder 5 decodes the stream signal and converts it into a signal SCE for the center speaker, signals SFL, SFR for the left and right front speakers, signals SRL, SRR for the left and right rear speakers and a signal SWF for the woofer.

The signals thus converted for the speakers are delayed, added and otherwise processed in the matrix processing circuit 6 as described later, and with the sound quality thereof adjusted in the equalizer 7, input to the amplifiers 11 to 16 for driving the speakers. The amplifier 11 is for driving the center speaker CE, the amplifier 12 for driving the left front speaker FL, the amplifier 13 for driving the right front speaker FR, the amplifier 14 for driving the left rear speaker RL, the amplifier 15 for driving the right rear speaker RR and the amplifier 16 for driving the woofer.

Now, the process of delaying and adding the driving signals for the speakers in the matrix processing circuit 6 according to the invention will be described below with reference to embodiments.

Figure 3:
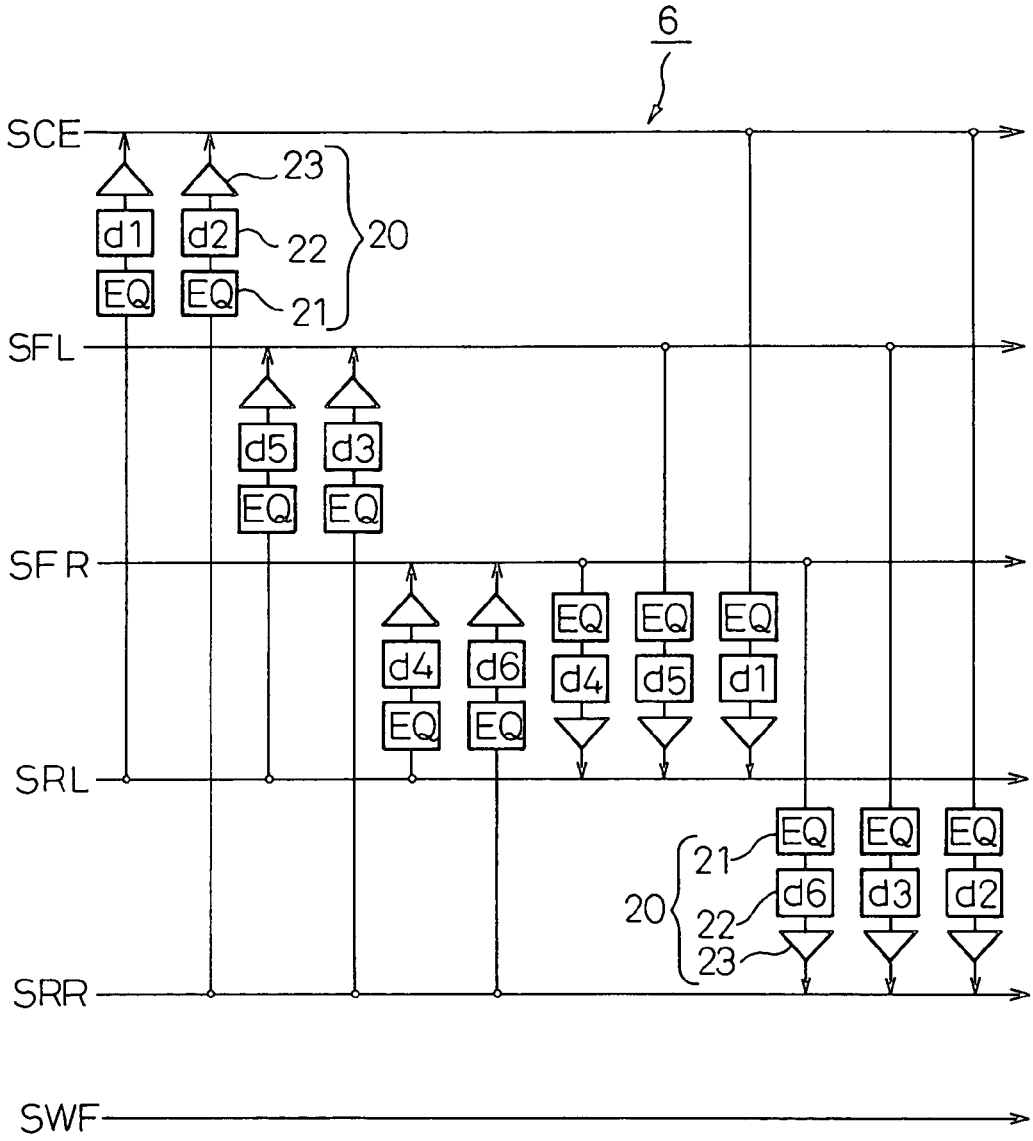
FIG. 3 is a block diagram showing a circuit configuration of the matrix processing circuit of FIG. 2 according to a first embodiment.

FIG. 3 is a block diagram showing the circuit configuration of the matrix processing circuit 6 of FIG. 2 according to a first embodiment. The reference characters noted on the left side of FIG. 3 designate the input signals to the matrix processing circuit 6 shown in FIG. 2. The matrix processing circuit 6 includes a plurality of signal processing circuits 20. These signal processing circuits 20 are each configured with an equalizer 21, a delay circuit 22 and an amplifier 23 connected in series. Reference numerals d1 to d3 in the delay circuit 22 indicate the delay time.

Figure 5A:
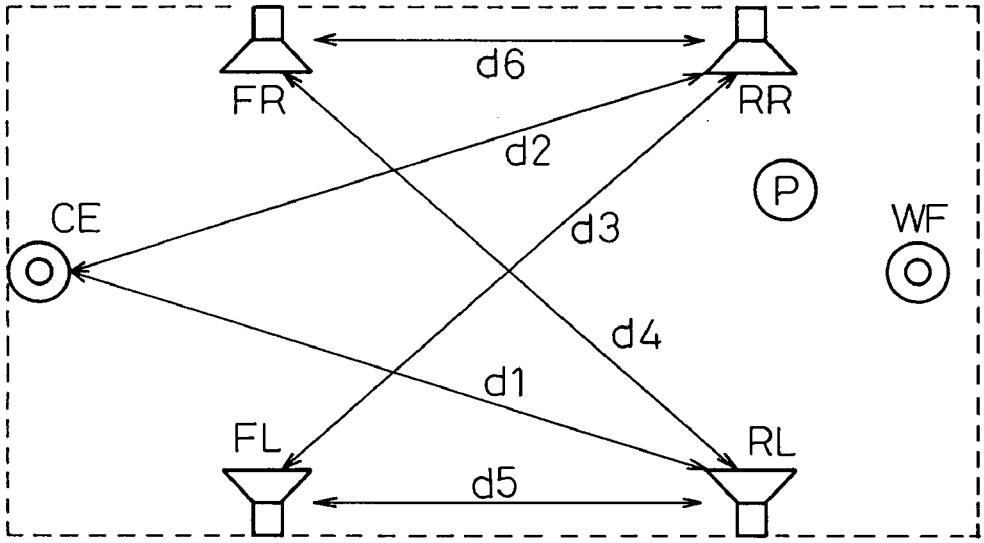
FIG. 5A is a diagram for explaining the delay time in the circuit of FIGS. 3 and 4.

The delay time d1, d2, as shown in FIG. 5A, represent the time before the sound output from the center speaker CE reaches the left and right rear speakers RL, RR, respectively, or the time before the sound output from the rear speakers RL, RR, respectively, reach the center speaker CE. The delay time d3, d4, on the other hand, represent the time before the sound output from the left and right front speakers FL, FR reach the opposed right and left rear speakers RR, RL, respectively, or the time before the sound output from the right and left rear speakers RR, RL reach the opposed left and right front speakers FL, FR, respectively. Further, the delay time d5, d6 represent the time before the sound output from the left and right front speakers FL, FR reach the adjacent left and right rear speakers RL, RR, respectively, or the time before the sound output from the left and right rear speakers RL, RR reach the adjacent left and right front speakers FL, FR, respectively. Thus, the relation holds that (d1≈d2)>(d3≈d4)>(d5≈d6).

According to the first embodiment, as shown in FIG. 3, the signal SCE to the center speaker CE is divided, and a branch signal, with the frequency characteristic thereof adjusted by the equalizer 21 of the signal processing circuit 20, is delayed by the time d2 by the delay circuit 22, followed by being adjusted in gain downward in the amplifier 23 and added to the signal SRR input to the right rear speaker RR. Also, the signal SFL to the left front speaker FL is divided, and a branch signal with the frequency characteristic thereof adjusted by the equalizer 21 of the signal processing circuit 20, is delayed by the time d3 by the delay circuit 22, followed by being adjusted in gain downward in the amplifier 23 and added to the signal SRR input to the right rear speaker RR. Further, the signal SFR to the right front speaker FR is divided, and a branch signal with the frequency characteristic thereof adjusted by the equalizer 21 of the signal processing circuit 20, is delayed by the time d6 by the delay circuit 22, followed by being adjusted in gain downward in the amplifier 23 and added to the signal SRR input to the right rear speaker RR.

In similar fashion, the signal SCE to the center speaker CE is divided by the signal processing circuits 20, and a branch signal with the frequency characteristic thereof adjusted, is delayed by the delay time d1, adjusted in gain and added to the signal SRL input to the left rear speaker RL. Also, the signal SFL to the left front speaker FL is divided by the signal processing circuits 20, and a branch signal with the frequency characteristic thereof adjusted, is delayed by the delay time d5, adjusted in gain, and added to the signal SRL input to the left rear speaker RL. Further, the signal SFR to the right front speaker FR is divided by the signal processing circuits 20, and a branch signal thereof, after being adjusted in the frequency characteristic, delayed by the delay time d4 and adjusted in gain, is added to the signal SRL input to the left rear speaker RL.

Conversely, the signal SRL to the left rear speaker RL is divided by the three signal processing circuits 20, so that a branch signal adjusted in frequency characteristic, delayed by the delay time d1 and adjusted in gain is added to the signal SCE input to the center speaker CE, another branch signal adjusted in frequency characteristic, delayed by the delay time d4 and adjusted in gain is added to the signal SFR input to the right front speaker FR, and still another branch signal adjusted in frequency characteristic, delayed by the delay time d5 and adjusted in gain is added to the signal SFL input to the left front speaker FL. In similar fashion, the signal SRR to the right rear speaker RR is divided by the three signal processing circuits 20, so that a branch signal adjusted in frequency characteristic, delayed by the delay time d2 and adjusted in gain is added to the signal SCE input to the center speaker CE, another branch signal adjusted in frequency characteristic, delayed by the delay time d3 and adjusted in gain is added to the signal SFL input to the left front speaker FL, and still another branch signal adjusted in frequency characteristic, delayed by the delay time d6 and adjusted in gain is added to the signal SFR input to the right front speaker FR.

As long as the center speaker CE is located on the center line of the vehicle, the relations can be maintained that d1=d2, d3=d4 and d5=d6.

As described above, according to the first embodiment, the sound output from the center speaker CE, after the frequency characteristic thereof is adjusted, is delayed and attenuated and added to the sound output from the left and right rear speakers RL, RR, while the sound output from the left and right front speakers FL, FR, after the frequency characteristic thereof is adjusted, is delayed and attenuated and added to the sound output from the left and right rear speakers RL, RR. Also, the sound output from the left and right rear speakers RL, RR, after the frequency characteristic thereof is adjusted, is delayed and attenuated and output by being added to the left and right front speakers FL, FR and the center speaker CE. The signal SWF to the woofer WF is output without being processed in any way. This is because the sound output from the woofer is very low in frequency, and therefore is heard substantially the same way at any seat in the cabin. Also, it is difficult to reproduce the band of the woofer sound by the other speakers.

Now, the attenuation characteristic of the amplifier 23 in each signal processing circuit 20 will be explained with reference to FIGS. 5A and 5B. The law of the first front (also called the Haas effect after the discoverer) has a controlling effect on the hearing sensation for the localization of the sound image in the direction of the sound wave arriving first at the position of the listener. According to this law, the reflected sounds arrive from various directions following the sound wave reaching the listener directly from the sound source in the cabin, but the listener hears the sound in the same manner as if the sound sources are located in the direction of the sound. The loudspeakers in the concert hall or the like are designed based on this law. Specifically, when the sound volume output from the front speaker of a singer singing on the stage is at a predetermined level, for example, the voice of the singer is heard as a low voice by the listeners in the rear seats. In order to compensate for this, the sound from the rear speakers installed in the rear part of the seats is delayed and is output by being attenuated as compared with the sound volume of the front speakers. In this way, the loud speaker system of the concert hall or the like is designed to add to the sound volume in such a manner as if the same sound as that from the stage (front speaker) is heard by the listener from the rear speakers.

Figure 5B:
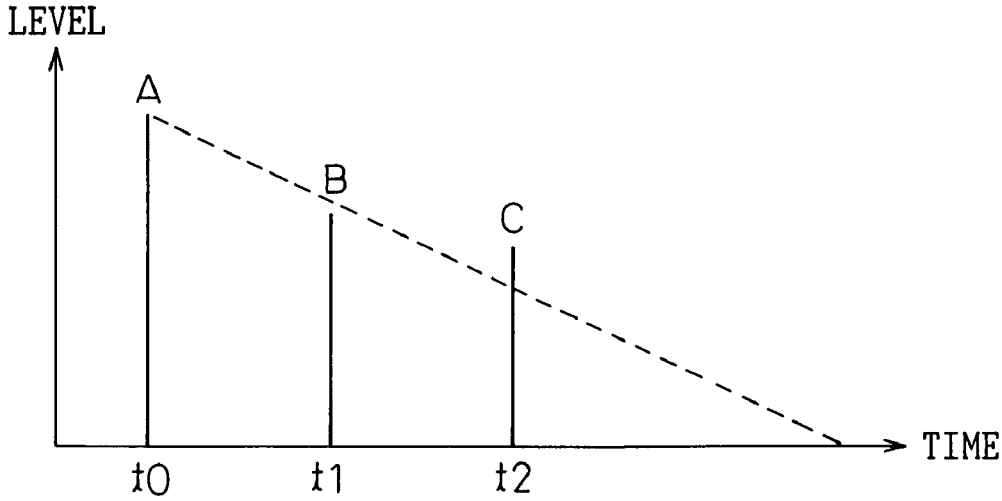
FIG. 5B is a characteristic diagram for explaining the delay time and the gain control of the circuit shown in FIGS. 3 and 4.

If it is assumed that the center speaker CE, the left and right front speakers FL, FR, the left and right rear speakers RL, RR and the woofer WF are installed in the automotive cabin as shown in FIG. 5A, and that a listener is seated at the position (rear seat) designated by P, the sound of level A shown in FIG. 5B is reproduced from the center speaker CE at time point t0. The dotted line lowering with time from the position of sound level A represents the attenuation characteristic according to the aforementioned law. If it is assumed that the same sound of level B is reproduced from the right front speaker FR at time point t1 slightly delayed behind time point t0, if the level B is lower than the attenuation characteristic curve, the sound of level B is not heard by the listener P as if it is output from the right front speaker FR but as a single reproduced sound of level A output from the center speaker CE.

If it is assumed that the same sound of level C is reproduced from the right rear speaker RR at time point t2 further delayed slightly, in the case where the level C is higher than the attenuation characteristic curve, the sound of level C is not heard by the listener as if it comes from the center speaker CE but as another sound output from the right rear speaker RR.

Thus, the delay characteristic of the delay circuit 22 and the attenuation characteristic of the amplifier 23 of each signal processing circuit 20 are based on the law of the first wave front. As a result, the in-cabin audio system according to the first embodiment can reproduce the sound similar to the original sound recorded in each channel of the DVD at the listener's position in the case where the multichannel sources recorded in the DVD are reproduced from a plurality of speakers.

Figure 4:
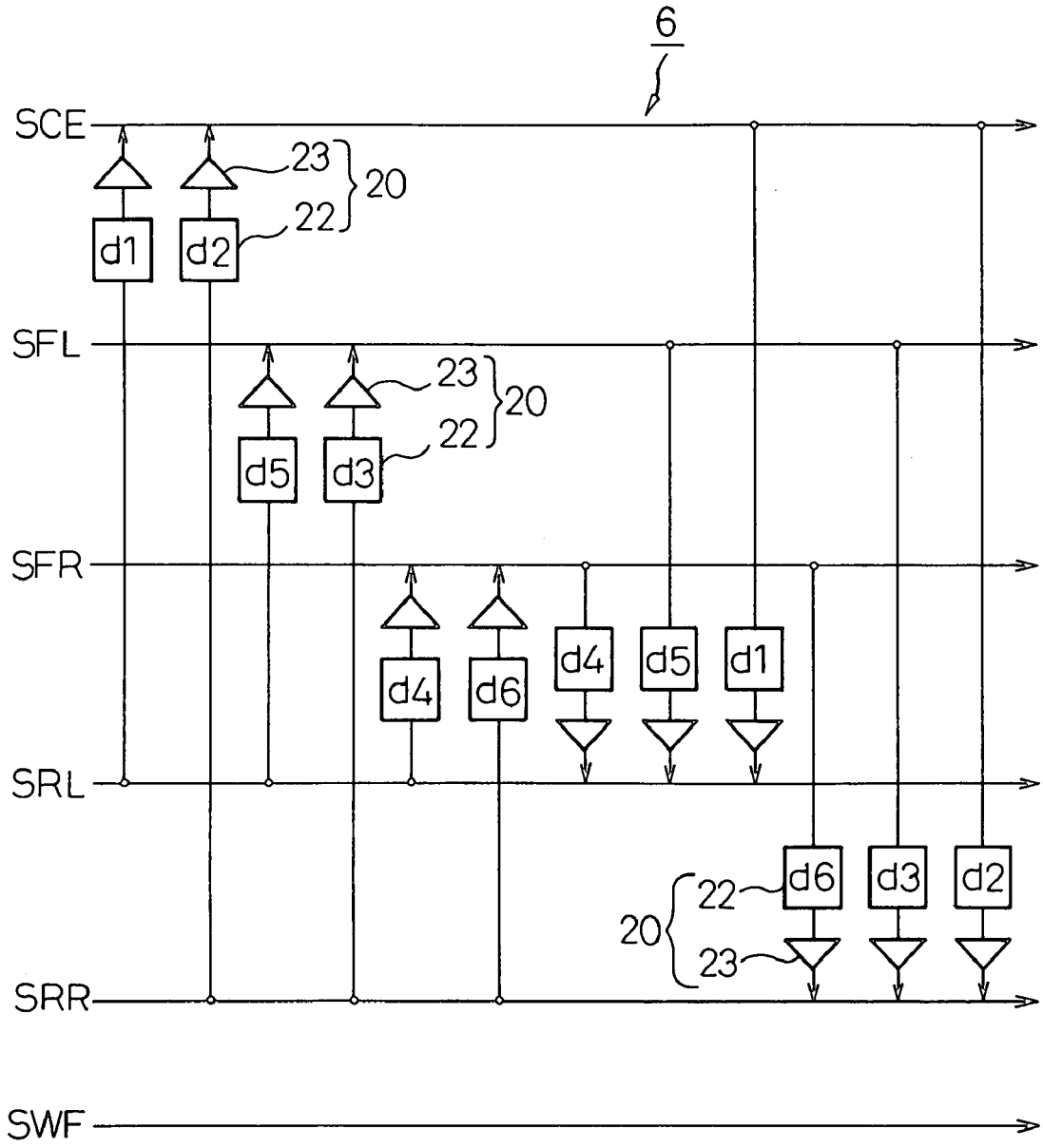
FIG. 4 is a block diagram showing a circuit configuration of the matrix processing circuit according to a modification of the first embodiment shown in FIG. 3.

FIG. 4 shows a configuration of the matrix processing circuit according to a modification of the first embodiment of FIG. 3. The modification shown in FIG. 4 is different from the first embodiment only in the lack of the equalizer 21 in each signal processing circuit 20, and is based on the same method of adding the signal of each speaker to the signals of other speakers as in the first embodiment. In this way, the absence of the equalizer 21 in the signal processing circuit 20 can reduce the processing amount and hence the size of the circuit configuration in spite of the slightly reduced latitude of sound correction.

Figure 6:
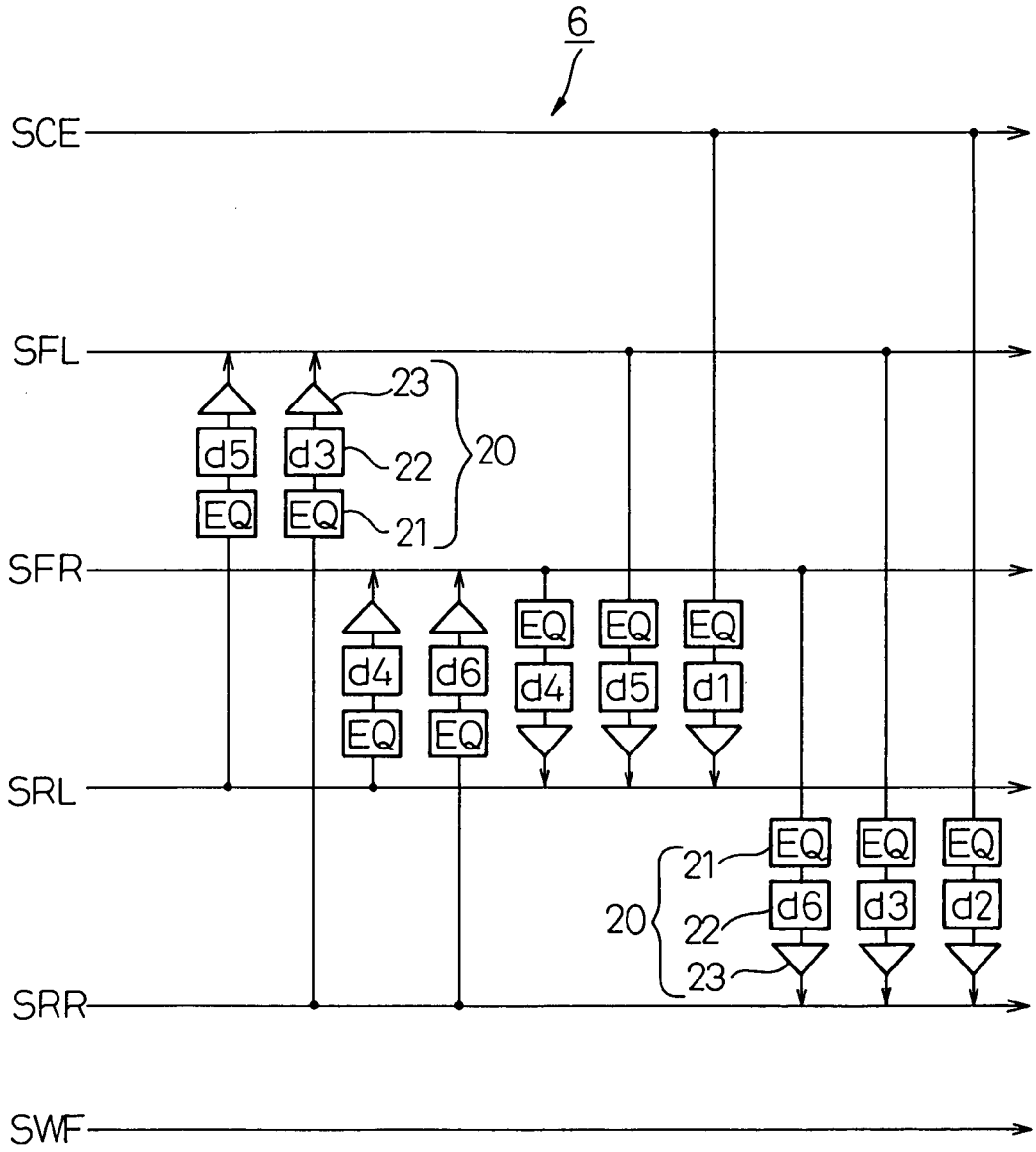
FIG. 6 is a block diagram showing a circuit configuration of the matrix processing circuit of FIG. 2 according to a second embodiment.

FIG. 6 shows a configuration of the matrix processing circuit 6 of FIG. 2 according to a second embodiment. In the first embodiment, the sound from the center speaker CE and the sound from the left and right front speakers FL, FR are output by being adjusted and added to the left and right rear speakers RL, RR, while the sound from the left and right rear speakers RL, RR are output by being adjusted and added to the left and right front speakers FL, FR and the center speaker CE. In the second embodiment, on the other hand, the sound from the center speaker CE and the sound from the left and right front speakers FL, FR are adjusted and added to the sound from the left and right rear speakers RL, RR as in the first embodiment, but the second embodiment is different from the first embodiment in that the sound from the left and right rear speakers RL, RR is adjusted and added only to the left and right front speakers FL, FR but not to the center speaker CE. This is because the left and right front speakers FL, FR and the center speaker CE, which are located forward as viewed from the rear speakers, can produce a substantially similar effect without adding the sound of the left and right rear speakers RL, RR to the center speaker CE.

Figure 7:
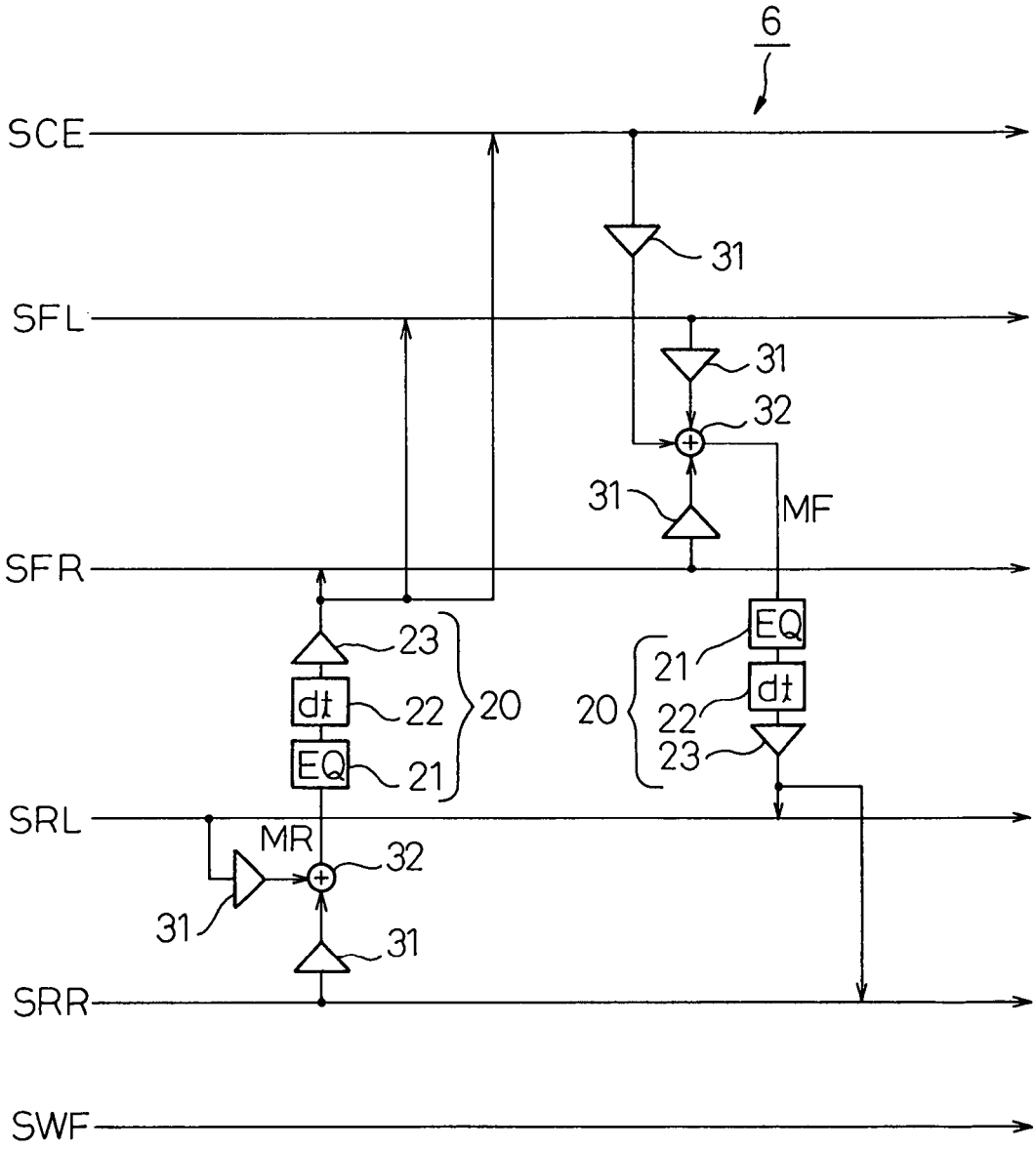
FIG. 7 is a block diagram showing a circuit configuration of the matrix processing circuit of FIG. 2 according to a third embodiment.

FIG. 7 shows a configuration of the matrix processing circuit of FIG. 2 according to a third embodiment. According to the first and second embodiments, the signal to each front speaker is added to the signal to each rear speaker or the signal to each rear speaker is added to the signal to each front speaker through a signal delay circuit 20 individually connected between each signal line to each speaker. According to the third embodiment, in contrast, in the case where the signal to each front speaker is added to the signal to each rear speaker, the signals to the front speakers are added in advance and the resulting signal is added to each rear speaker through a single signal processing circuit 20. Also, in the case where the signal to each rear speaker is added to the signal to each front speaker, the signals to the rear speakers are added in advance and the resulting signal is added to each front speaker through a single signal processing circuit 20.

According to the third embodiment, therefore, as shown in FIG. 7, the signal SCE to the center speaker CE, the signal SFL to the left front speaker FL and the signal SFR to the right front speaker FR branch off, and each branching signal is input to an adder 32 through a gain regulator 31. The adder 32 adds the signal SCE to the center speaker CE, the signal SFL to the left front speaker FL and the signal SFR to the right front speaker FR, thus producing a synthetic signal MF, which is applied to the signal processing circuit 20.

The signal processing circuit 20, which has the same configuration as in the first and second embodiments, includes an equalizer 21, a delay circuit 22 and an amplifier 23. The synthetic signal MF input to the signal processing circuit 20, after being adjusted in frequency characteristic by the equalizer 21, is delayed by time dt by the delay circuit 22. The delay signal branches after being adjusted in gain downward by the amplifier 23, and is added to the signal SRL to the left speaker RL and the signal SRR to the right rear speaker RR.

On the other hand, the signal SRL to the left rear speaker RL and the signal SRR to the right rear speaker RR also branch, and are input to the adder 32 through the gain regulator 31. The adder 32 adds the signal SRL input to the left rear speaker RL and the signal SRR input to the right rear speaker RR, and thus produces a synthetic signal MR, which is input to the signal processing circuit 20. The synthetic signal MR input to the signal processing circuit 20, after being adjusted in frequency characteristic in the equalizer 21 and delayed by time dt by the delay circuit 22, is adjusted in gain downward by the amplifier 23. The resulting signal branches, and is added to the signal SCE input to the center speaker CE, the signal SRL input to the left speaker RL and the signal SRR input to the right rear speaker RR.

Also in the third embodiment, the delay time in the delay circuit 22 of the signal processing circuit 20 and the gain attenuation characteristic of the amplifier 23 are determined in accordance with the law of the first wave front described with reference to FIG. 5B. According to the third embodiment, the amount of signal processing is reduced ignoring the small difference of delay time between the front speakers and the rear speakers. In a small space like the automotive cabin, a considerable effect is achieved even if a small delay time is ignored between each of the front speakers and each of the rear speakers.

Figure 8:
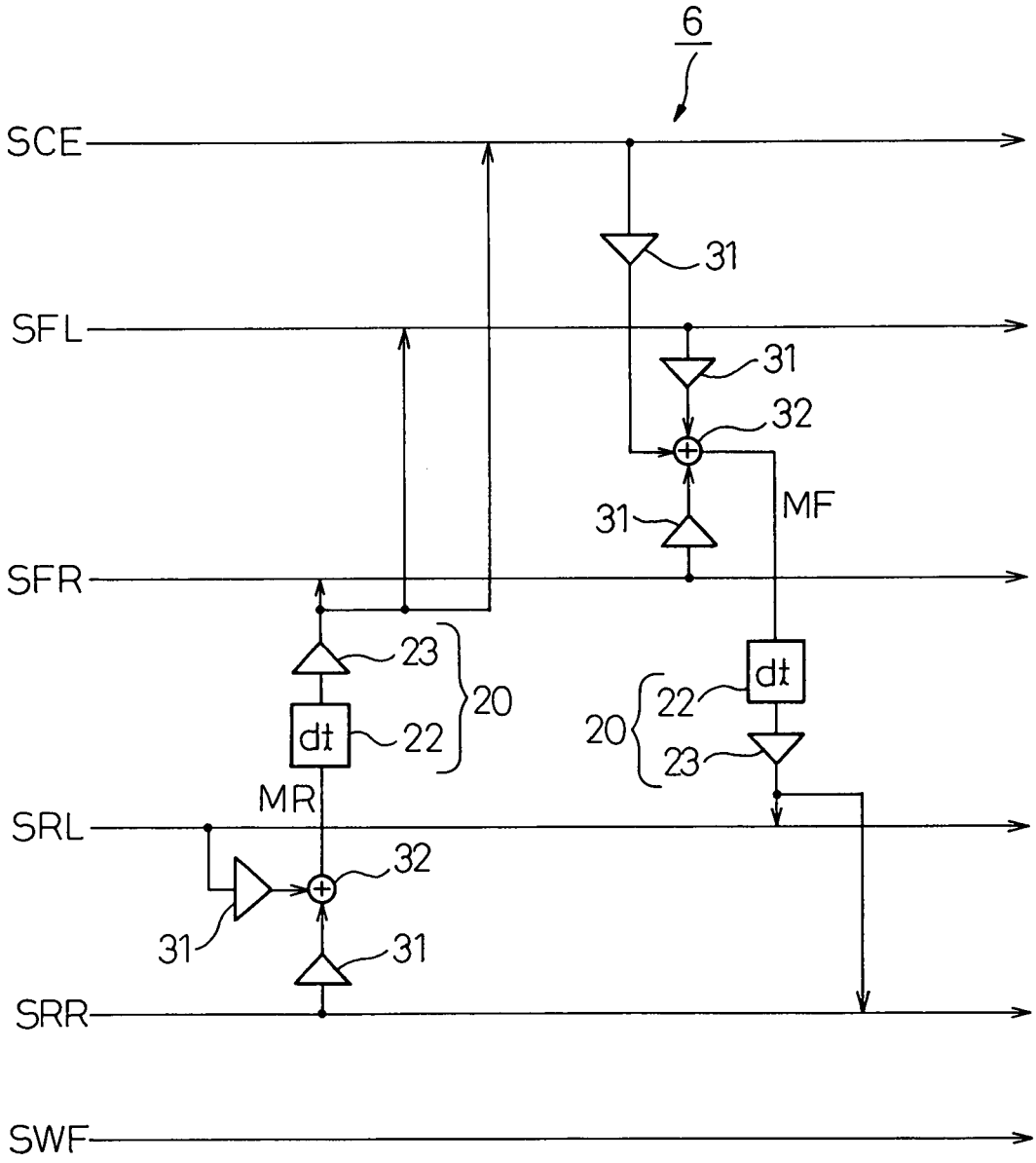
FIG. 8 is a block diagram showing a circuit configuration of the matrix processing circuit according to a modification of the third embodiment shown in FIG. 7.

FIG. 8 shows a configuration of the matrix processing circuit 6 according to a modification of the third embodiment. The modification of FIG. 7 is different from the third embodiment only in the lack of the equalizer 21 from each signal processing circuit 20. The signal to each speaker is added to the signals to other speakers by the same method as that of the third embodiment. In this way, the absence of the equalizer 21 in the signal processing circuit 20 can reduce the amount of processing and hence the size of the circuit configuration at the sacrifice of a somewhat reduced latitude of sound correction.

Figure 9:
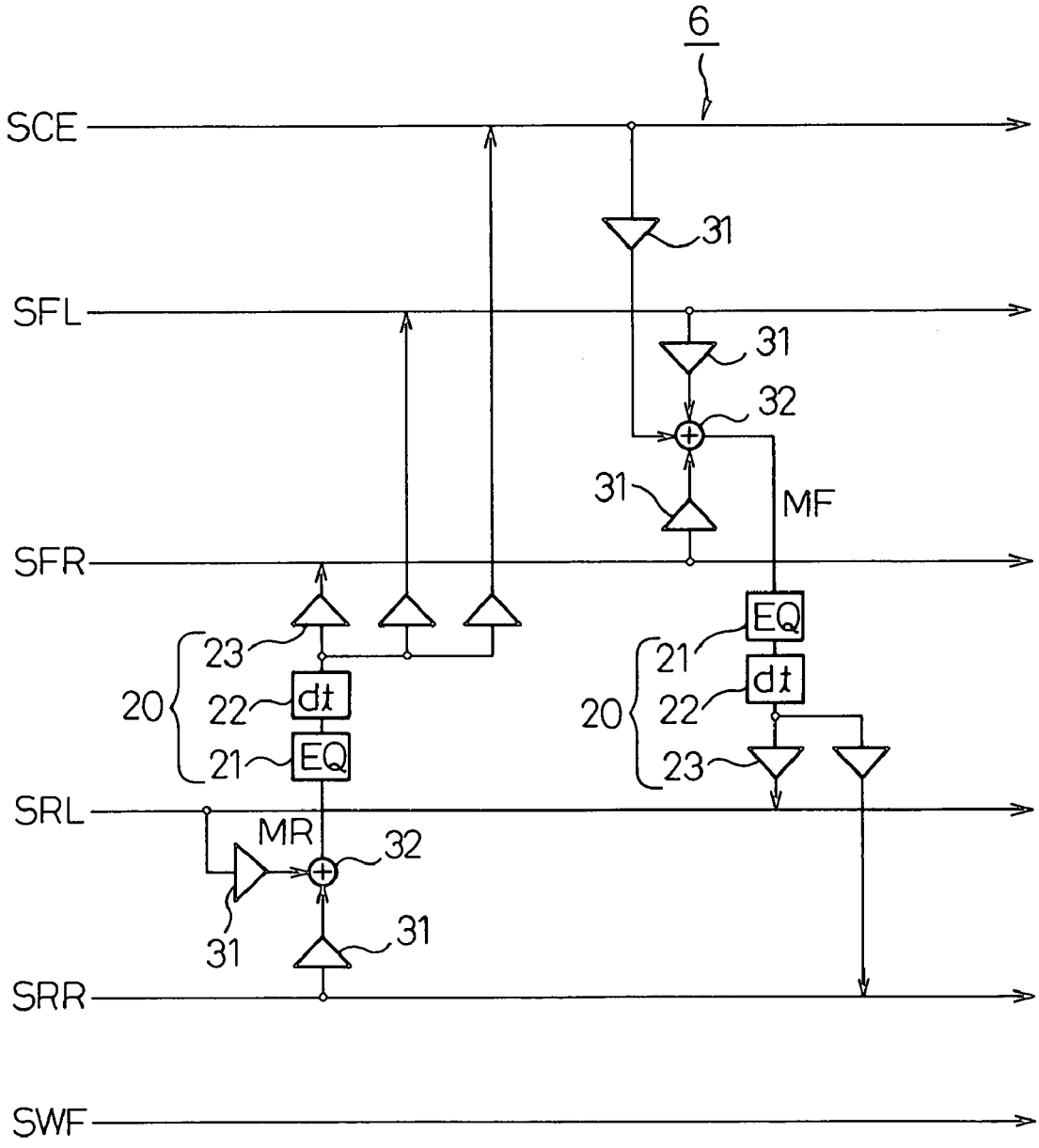
FIG. 9 is a block diagram showing a circuit configuration of the matrix processing circuit of FIG. 2 according to a fourth embodiment.

FIG. 9 shows a configuration of the matrix processing circuit 6 of FIG. 2 according to a fourth embodiment. The fourth embodiment is different from the third embodiment only in the manner in which the output of the signal processing circuit 20 is applied to the left and right front speakers FL, FR and the left and right rear speakers RL, RR.

According to the third embodiment, the output of the signal processing circuit 20 is applied to the left and right front speakers FL, FR and the left and right rear speakers RL, RR with the same gain. The fourth embodiment, on the other hand, comprises as many independent amplifiers 23 of the signal processing circuit 20 as the destination lines. As long as the gain of each amplifier 23 is adjustable, therefore, the level of the sound reproduced from each speaker can be adjusted appropriately in accordance with the position of the listener seated in the cabin by regulating the gain of each amplifier 23 in accordance with the position of the listener.

Figure 10:
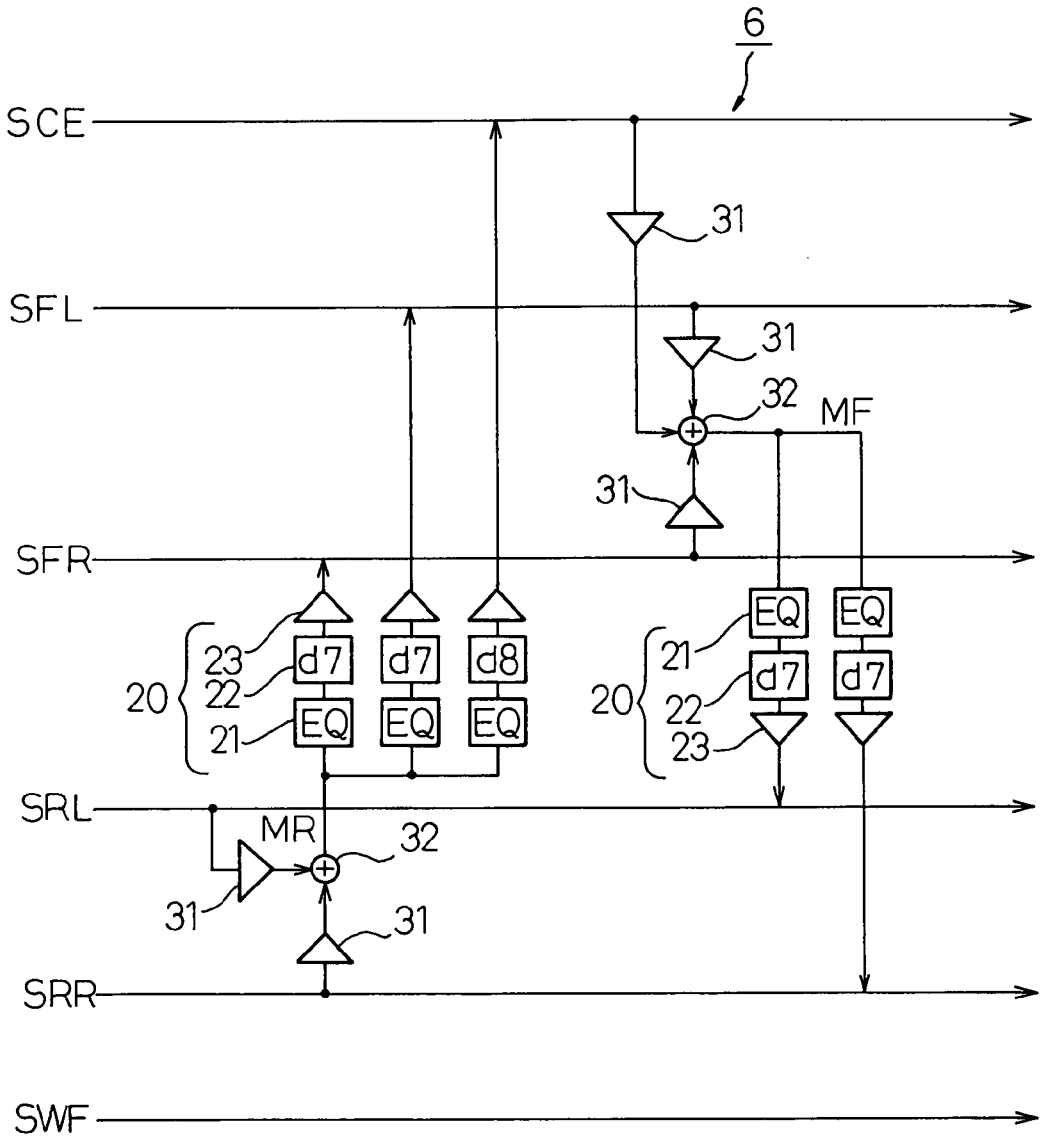
FIG. 10 is a block diagram showing a circuit configuration of the matrix processing circuit of FIG. 2 according to a fifth embodiment.

FIG. 10 shows a configuration of the matrix processing circuit 6 of FIG. 2 according to a fifth embodiment. The fifth embodiment is different from the third embodiment only in the provision of as many signal processing circuits 20 as the destination lines.

According to the third embodiment, the output of the signal processing circuit 20 is applied to the left and right front speakers FL, FR and the left and right rear speakers RL, RR with the same gain. In the fifth embodiment comprising as many signal processing circuits 20 as the destination lines, on the other hand, as long as the delay time of each delay circuit 22 of each signal processing circuit 20 and the gain of each amplifier 23 are adjustable, the level of the reproduced sound from each speaker can be appropriately adjusted in accordance with the position of the listener by adjusting the delay time of each delay circuit 22 and the gain of each amplifier 23. According to the fifth embodiment, only the delay time of the delay circuit 22 of the signal processing circuit 20 connected to the signal SCE input to the center speaker CE is differentiated from the other delay time.

FIG. 11 shows the relation between the seat priority mode and the gain of each speaker in an application of the invention to a three-row seat vehicle. In the case where three rows of seats are arranged in the automotive cabin, this embodiment permits the priority to be switched to the row of seats in which a given listener is seated. In the case where the seats in the first row are given priority, for example, the priority mode is set to the first row of the seats so that the sound pressure of the left and right rear speakers RL, RR rises. In the process, the sound pressure of the left and right front speakers FL, FR and the center speaker CE are maintained at an intermediate level. In the case where the seats in the second row are given priority, on the other hand, the priority mode is switched to the second row of the seats. In this case, the sound pressure of the left and right rear speakers RL, RR, the sound pressure of the left and right front speakers FL, FR and the sound pressure of the center speaker CE are all maintained at about an intermediate level. Further, in the case where the seats in the third row are given priority, the priority mode is switched to the seats in the third row, so that the sound pressure of the left and right rear speakers RL, RR is maintained at about an intermediate level while the sound pressure of the left and right front speakers FL, FR and the center speaker CE is raised.

As described above, an in-cabin audio system according to this invention is applicable with equal effect to the audio system installed in the cabin of the automobile having three rows of seats.

The embodiments described above refer to the in-cabin audio system using the DVD player. Nevertheless, the multichannel player is not specifically limited to the DVD player.

Also, apart from the in-cabin audio system described in the foregoing embodiments, the present invention is effectively applicable also to the case in which the sound of a multichannel player is reproduced in an ordinary room of a house.

It will thus be understood from the foregoing description that according to the present invention, there is provided an in-cabin audio system, in which multichannel sources recorded in a medium are reproduced from speakers installed at as many points as the channels involved in such a manner that the signal reproduced from the player for the medium is processed in an amplifier unit arranged in the stage before each speaker. In this way, the sound similar to the original sound recorded in the medium can be reproduced at the position of the listener.

What is claimed is:

1. An audio system for reproducing six independent original audio signals at six reproduction points in an audio space, wherein said six independent original audio signals are a center signal reproduced at front center in the audio space, left and right front signals reproduced at front left and right sides in the audio space, left and right rear signals reproduced at rear left and right sides in the audio space, and a bass audio signal, the audio system comprising:

a first processing portion for producing a first processed sound signal by delaying and attenuating an amplitude level of one of the left and right front signals in accordance with a distance between the reproduction point of said one of the left and right front signals and the reproduction point of one of the left and right rear signals;

a second processing portion for producing a second processed sound signal by delaying and attenuating an amplitude level of one of the left and right rear signals in accordance with a distance between the reproduction point of said one of the left and right rear signals and the reproduction point of one of the left and right front signals;

a first adding portion for adding said first processed sound signal to said one of the left and right rear signals; and a second adding portion for adding said second processed sound signal to said one of the left and right front signals;

wherein said first and second processing portions attenuate the respective amplitude level in accordance with a predetermined stereo audio effect.

2. An audio system according to claim 1, further comprising:

a third processing portion for producing a third processed sound signal by delaying and attenuating an amplitude level of the center signal in accordance with a distance between the reproduction point of said center signal and the reproduction point of one of the left and right rear signals; and a third adding portion for adding said third processed sound signal to said one of the left and right rear signals;

wherein said third processing portion attenuates the amplitude level in accordance with a predetermined stereo audio effect.

3. An audio system according to claim 2, further comprising:

a fourth processing portion for producing a fourth processed sound signal by delaying and attenuating an amplitude level of one of the left and right rear signals in accordance with a distance between the reproduction point of said one of the left and right rear signals and the reproduction point of the center signal; and a fourth adding portion for adding said fourth processed sound signal to said center signal;

wherein said fourth processing portion attenuates the amplitude level in accordance with a predetermined stereo audio effect.

4. An audio system according to claim 1, wherein said first and second processing portions are configured to correct a frequency characteristic of each processed sound signal.

5. An audio system according to claim 1, further comprising a multichannel player unit for reproducing said six independent original audio signals recorded on a recording medium by a multichannel recording system.

6. An audio system according to claim 1, further comprising a switch for setting a priority mode to determine a listening point in said audio space which receives optimum sound, and said amplitude levels are changed in accordance with the setting of said switch.

7. An audio system according to claim 1, wherein said predetermined stereo audio effect is a Haas effect.

8. An audio system for reproducing six independent original audio signals at six reproduction points in an audio space, wherein said six independent original audio signals are a center signal reproduced at front center in the audio space, left and right front signals reproduced at front left and right sides in the audio space, left and right rear signals reproduced at rear left and right sides in the audio space, and a bass audio signal, the audio system comprising:

a first adding portion for adding said left and right front signals to generate a first added signal;

a second adding portion for adding said left and right rear signals to generate a second added signal;

a first processing portion for producing a first processed sound signal by delaying and attenuating an amplitude level of said first added signal in accordance with a distance between the reproduction point of one of the left and right front signals and the reproduction point of one of the left and right rear signals;

a second processing portion for producing a second processed sound signal by delaying and attenuating an amplitude level of said second added signal in accordance with a distance between the reproduction point of one of the left and right rear signals and the reproduction point of said center signal;

a third adding portion for adding said first processed sound signal to said left and right rear signals; and a fourth adding portion for adding said second processed sound signal to said left and right front signals;

wherein said first and second processing portions attenuate the respective amplitude level in accordance with a predetermined stereo audio effect.

9. An audio system according to claim 8, wherein said first adding portion produces said first added signal by further adding said center signal.

10. An audio system according to claim 8, further comprising a fifth adding portion for adding said second processed sound signal to said center signal.

11. An audio system according to claim 8, further comprising:

a third processing portion for producing a third processed sound signal by delaying and attenuating an amplitude level of said second added signal in accordance with a distance between the reproduction point of one of the left and right rear signals and the reproduction point of said center signal; and a sixth adding portion for adding said third processed sound signal to said left and right front signals;

wherein said third processing portion attenuates the amplitude level of the second added signal in accordance with a predetermined stereo audio effect.

12. An audio system according to claim 8, wherein said first and second processing portions correct a frequency characteristic of each processed sound signal.

13. An audio system according to claim 8, further comprising with a multichannel player unit for reproducing said six independent original audio signals recorded on a recording medium by a multichannel recording system.

14. An audio system according to claim 8, further comprising a switch for setting a priority mode to determine a listening point in said audio space which receives optimum sound, and said amplitude levels are changed in accordance with the setting of said switch.

15. An audio system according to claim 8, wherein said predetermined stereo audio effect is a Haas effect.

16. A method of reproducing six independent original audio signals at six reproduction points in an audio space, wherein said six independent original audio signals are a center signal reproduced at front center in the audio space, left and right front signals reproduced at front left and right sides in the audio space, left and right rear signals reproduced at rear left and right sides in the audio space, and a bass audio signal, the method comprising:

producing a first processed sound signal by delaying and attenuating an amplitude level of one of the left and right front signals in accordance with a distance between the reproduction point of said one of the left and right front signals and the reproduction point of one of the left and right rear signals;

producing a second processed sound signal by delaying and attenuating an amplitude level of one of the left and right rear signals in accordance with a distance between the reproduction point of said one of the left and right rear signals and the reproduction point of one of the left and right front signals;

adding said first processed sound signal to said one of the left and right rear signals;

adding said second processed sound signal to said one of the left and right front signals; and attenuating the amplitude levels in accordance with a predetermined stereo audio effect.

17. A method of reproducing audio signals according to claim 16, the method further comprising:

producing a third processed sound signal by delaying and attenuating an amplitude level of the center signal in accordance with a distance between the reproduction point of said center signal and the reproduction point of one of the left and right rear signals;

adding said third processed sound signal to said one of the left and right rear signals; and attenuating the amplitude level of the center signal in accordance with a predetermined stereo audio effect.

18. A method of reproducing audio signals according to claim 16, the method further comprising:

producing a fourth processed sound signal by delaying and attenuating an amplitude level of one of the left and right rear signals in accordance with a distance between the reproduction point of said one of the left and right rear signals and the reproduction point of the center signal;

adding said fourth processed sound signal to said center signal; and attenuating the amplitude level of said one of the left and right rear signals in accordance with a predetermined stereo audio effect.

19. A method of reproducing audio signals according to claim 16, further comprising correcting a frequency characteristic of each processed sound signal.

20. A method of reproducing audio signals according to claim 16, wherein said six independent original audio signals are supplied from a multichannel player unit which reproduces audio signals recorded on a recording medium by a multichannel recording system.

21. A method of reproducing audio signals according to claim 16, further comprising setting a priority mode which determines a listening point in said audio space for receiving optimum sound, and charging said amplitude levels in accordance with the setting of said priority mode.

22. A method of reproducing audio signals according to claim 16, wherein said predetermined stereo audio effect is a Haas effect.

23. A method of reproducing six independent original audio signals at six reproduction points in an audio space, wherein said six independent original audio signals are a center signal reproduced at front center in the audio space, left and right front signals reproduced at front left and right sides in the audio space, left and right rear signals reproduced at rear left and right sides in the audio space, and a bass audio signal, the method comprising:

adding said left and right front signals to make a first added signal;

adding said left and right rear signals to make a second added signal;

producing a first processed sound signal by delaying and attenuating an amplitude level of said first added signal in accordance with a distance between the reproduction point of one of the left and right front signals and the reproduction point of one of the left and right rear signals;

producing a second processed sound signal by delaying and attenuating an amplitude level of said second added signal in accordance with a distance between the reproduction point of one of the left and right rear signals and the reproduction point of center signal;

adding said first processed sound signal to said left and right rear signals;

adding said second processed sound signal to said left and right front signals; and attenuating the amplitude levels in accordance with a predetermined stereo audio effect.

24. A method of reproducing audio signals according to claim 23, wherein said first added signal is produced by further adding said center signal.

25. A method for reproducing audio signals according to claim 23, further comprising adding said second processed sound signal to said center signal.

26. A method for reproducing audio signals according to claim 23, the method further comprising:

producing a third processed sound signal by delaying and attenuating an amplitude level of said second added signal in accordance with a distance between the reproduction point of one of the left and right rear signals and the reproduction point of said center signal;

adding said third processed sound signal to said left and right front signals; and attenuating the amplitude level of the second added signal in accordance with a predetermined stereo audio effect.

27. A method of reproducing audio signals according to claim 23, further comprising correcting a frequency characteristic of each processed sound signal.

28. A method of reproducing audio signals according to claim 23, wherein said six independent original audio signals are supplied from a multichannel player unit which reproduces audio signals recorded on a recording medium by a multichannel recording system.

29. A method of reproducing audio signals according to claim 23, further comprising setting a priority mode which determines a listening point in said audio space for receiving optimum sound, and changing said amplitude levels in accordance with the setting of said priority mode.

30. A method of reproducing audio signals according to claim 23, wherein said predetermined stereo audio effect a Haas effect.

* * * * *

UNITED STATES PATENT AND TRADEMARK OFFICE

CERTIFICATE OF CORRECTION

PATENT NO. : 7,218,740 B1
APPLICATION NO. : 09/578355
DATED : May 15, 2007
INVENTOR(S) : Hiroshi Kowaki It is certified that error appears in the above-identified patent and that said Letters Patent is hereby corrected as shown below:

In the Claims

| | |
|---|---|
| Column 12, line 45, Claim 13 | Before "a",<br>Delete "with" |
| Column 13, line 50, Claim 21 | Delete "charging",<br>Insert --changing-- |
| Column 14, line 56, Claim 30 | After "effect",<br>Insert --is-- |

Signed and Sealed this

Nineteenth Day of August, 2008

JON W. DUDAS
*Director of the United States Patent and Trademark Office*